US006434839B1

(12) United States Patent
Lee et al.

(10) Patent No.: US 6,434,839 B1
(45) Date of Patent: Aug. 20, 2002

(54) SAFETY RAZOR

(75) Inventors: Hyung-Jae Lee; Byung-Sun Ahn, both of Yongin-shi (KR)

(73) Assignee: Dorco Co., Ltd., Yongin (KR)

( * ) Notice: Subject to any disclaimer, the term of this patent is extended or adjusted under 35 U.S.C. 154(b) by 0 days.

(21) Appl. No.: 09/781,322

(22) Filed: Feb. 13, 2001

(30) Foreign Application Priority Data

Jun. 24, 2000 (KR) ..... 2000-35138

(51) Int. Cl.[7] ..... B26B 21/52
(52) U.S. Cl. ..... 30/532; 30/527
(58) Field of Search ..... 30/527, 532, 57, 30/530

(56) References Cited

U.S. PATENT DOCUMENTS 4,266,340 A * 5/1981 Bowman ..... 30/532
4,347,663 A * 9/1982 Ullmo ..... 30/527
5,157,834 A * 10/1992 Chen et al. ..... 30/532
5,784,790 A * 7/1998 Carson, III et al. ..... 30/532
5,794,354 A * 8/1998 Gilder ..... 30/527
6,122,826 A * 9/2000 Coffin et al. ..... 30/527

* cited by examiner

*Primary Examiner*—Hwei-Slu Payer
(74) *Attorney, Agent, or Firm*—Staas & Halsey LLP

(57) ABSTRACT

A safety razor is disclosed. In this razor, the head of the handle allows a blade cartridge to move on the curved skin while being smoothly, sensitively and elastically rotated around the hinged points. The razor is also provided with separate elastic biasing members for respectively allowing the desired elastic swinging action of the blade cartridge relative to the head and allowing an easy attachment or removal of the blade cartridge relative to the head. In the safety razor, the hinged points of the cartridge are positioned at the front end of the head at a position below the central axis of the cartridge, thus allowing the cartridge to be rotatable backward around the hinged points at an enlarged swing angle when a user unconsciously and excessively presses the cartridge against the skin while shaving. This razor thus safely and cleanly shaves the face while maintaining a uniform skin contact area and uniform skin contact pressure without damaging or cutting the skin regardless of a variety of cutting resistances applied to the cartridge due to various hair densities and various curvatures of the face.

4 Claims, 10 Drawing Sheets

SAFETY RAZOR

BACKGROUND OF THE INVENTION

1. Field of the Invention

The present invention relates to safety razors having a detachable blade cartridge, and, more particularly, to a safety razor designed to improve the moving trace of the blade cartridge on the curved skin of the face, thus maintaining a uniform skin contact area and uniform skin contact pressure, with the hinge points of the blade cartridge of the razor provided at the handle of the razor at a position below the central axis of the cartridge so as to enlarge the swing angle of the cartridge, and allow the blades of the cartridge to effectively and cleanly shave the face without damaging or cutting the skin regardless of a variety of cutting resistances applied to the cartridge due to various hair densities and various curvatures of the face, the razor also having an elastic actuation unit used for smoothly and elastically rotating the blade cartridge around the head, and removing the cartridge from the head as desired.

2. Description of the Prior Art

Safety razors, with a guard to prevent the blade from cutting the skin, are designed such that a blade cartridge having multiple blades is movably and detachably attached to the head of a handle so as to smoothly swing around its hinged points according to the curvature of the user's face. An example of such safety razors is referred to Japanese Patent Laid-open Publication No. Heisei. 3-52,319. This Japanese safety razor comprises two cartridge holding arms, which are hinged at opposite ends of the head of a handle so as to be rotatable in opposite directions around their hinged points. A spring-biased actuation button is set in the head of the handle at the middle portion between the two arms such that the button is elastically movable forward or backward. When the button is moved to the back, the two holding arms are closed. When the button is moved forward while compressing the spring, the two holding arms are open to allow an attachment or removal of a blade cartridge relative to the head of the handle. A pusher is provided between the two holding arms, and comes into pressure contact with the blade cartridge at its front end. The blade cartridge is thus rotatable around the hinge shafts of the two holding arms at a predetermined angle.

However, this safety razor is problematic in that the two holding arms may be undesirably or unconsciously opened to allow the cartridge to be removed from the razor since the holding arms in the closed position are supported only by the spring.

In an effort to overcome such problems, Japanese Patent Laid-open Publication No. Heisei. 11-156068 discloses a safety razor, which is designed to reinforce the spring force of the spring biasing the cartridge holding arms, thus almost completely preventing the holding arms from being undesirably or unconsciously opened. In order to accomplish the above object, this razor comprises two cartridge holding arms, which are hinged at opposite ends of the head of a handle so as to be rotatable in opposite directions around their hinged points. An actuation unit is set in the handle, and is used for actuating the two cartridge arms. A movable pusher is provided in the head of the razor at the central portion such that the pusher is movable forward and backward, with an elastic biasing member set between the movable pusher and the actuation unit. When a blade cartridge is firmly attached to the head of the razor, the cartridge pushes the pusher to the back while compressing the elastic biasing member. Therefore, due to the spring force of the compressed biasing member, the two cartridge holding arms are held in the closed position.

In the above razor, the blade cartridge is rotatable around the cartridge holding arms of the head. In addition, the attachment or removal of the blade cartridge relative to the head of the razor is accomplished by a forward and backward movement of the spring-biased pusher. Therefore, the swing angle of the blade cartridge relative to the head is undesirably limited. In addition, it is almost impossible for the blade cartridge to move precisely, and so the blades of the cartridge fail to effectively or cleanly shave the face, but may damage or cut the skin of the face while shaving. Another problem experienced in the above safety razor resides in that the two cartridge holding arms are operated in conjunction with the spring-biased pusher at the same time, thus creating mechanical friction and overloading the cooperation mechanism provided between the two holding arms and the pusher. The hinge points of the two cartridge holding arms are aligned with two projections formed at the front end of the pusher, and so it is almost impossible to smoothly or easily attach or remove a blade cartridge relative to the head of the razor when either the two cartridge holding arms or the pusher fails to desirably operate.

Each of the above-mentioned two Japanese safety razors uses a blade cartridge, which comprises one or more blades, a cap holding the blades, and a guard for preventing the blades from cutting the skin. In the above razors, the hinged points of the blade cartridge are positioned along the central axis of the cartridge. That is, in the case of a blade cartridge having double blades, the hinged points are positioned along an axis extending between the two blades in parallel to the two blades. Therefore, when the blade cartridge is rotated with reverse moment while shaving, the blades may cut the skin. In addition, the pressure of the blades is directly applied to the skin of the face while shaving, and so it is almost impossible for the blade cartridge to smoothly move on the skin while sensitively responding to any curvature of the skin or any blemishes on the skin. When the hinged points are set along the central axis of the guard of the cartridge so as to prevent an increase in the resistance acting on the blades of the cartridge according to the hair density while shaving, the swinging action of the cartridge is undesirably stopped in the case of an excessive increase in the pressure acting on the cartridge while shaving. In such a case, the blades of the cartridge damage or cut the skin.

SUMMARY OF THE INVENTION

Accordingly, the present invention has been made keeping in mind the above problems occurring in the prior art, and an object of the present invention is to provide a safety razor, which is structurally improved in the blade cartridge, the cartridge holder, and the head of the handle to allow the blade cartridge to move on the curved skin while being smoothly, sensitively and elastically rotated around the hinged points at an enlarged swing angle, and which is provided with separate elastic biasing members for respectively allowing the desired elastic swinging action of the blade cartridge relative to the head of the handle and allowing an easy attachment or removal of the blade cartridge relative to the head, and which is thus improved in its operational reliability and durability, and is almost free from damaging or cutting the skin while shaving.

Another object of the present invention is to provide a safety razor, of which the hinged points of the blade cartridge are positioned at the front end of the head of the handle at a position below the central axis of the cartridge, thus allowing the cartridge to be rotatable backward around the hinged points at an enlarged swing angle when a user unconsciously and excessively presses the cartridge against the skin while shaving, and which thus safely and cleanly shaves the face while maintaining a uniform skin contact area and uniform skin contact pressure without damaging or cutting the skin, regardless of a variety of cutting resistances applied to the cartridge due to various hair densities and various curvatures of the face.

In order to accomplish the above object, the present invention provides a safety razor, comprising a blade cartridge removably and rotatably attached to the head of a handle, wherein the blade cartridge is attached to the head at the hinged points formed at the front end of the head at a position below the central axis of the cartridge, thus allowing the rotatable cartridge to create a single directional moment during a rotating action of the cartridge around the hinge points and allowing a restoring moment of the cartridge to be applied to only a cartridge holder of the handle, and preventing the blade of the cartridge from forming any pressure capable of damaging or cutting the skin while shaving. In the safety razor, the cartridge is rotatable backward around the hinged points at an enlarged swing angle when a user unconsciously and excessively presses the cartridge against the skin while shaving, thus safely and cleanly shaving the face while maintaining a uniform skin contact area and uniform skin contact pressure without damaging or cutting the skin.

In the preferred embodiment, the safety razor comprises a handle having a head provided with a mounting depression, a center channel axially extending from the depression to the front edge of the head, and a knob seat opening formed at the upper surface of the head; an elastic actuation unit seated in the mounting depression of the head and consisting of: a base block seated in the mounting depression of the head and having an axial bore, with a first pusher movably seated in the axial bore while being normally biased forward by a first biasing member; a second pusher axially and movably seated on the base block, with a second biasing member normally biasing the second pusher to the back relative to the base block; and an actuation knob seated on the knob seat opening of the head, and elastically moving the second pusher forward or backward in accordance with an operation of a user; a cartridge holder rotatably attached to the front end of the head, the cartridge holder being provided with a cam surface for being normally biased by the first pusher so as to elastically return to its stop position, the cartridge holder also having a plurality of cartridge locking pieces; and a blade cartridge having a projection formed on its lower surface at a middle portion, and removably attached to the cartridge locking pieces of the cartridge holder such that the front end of the second pusher comes into contact with the projection.

BRIEF DESCRIPTION OF THE DRAWINGS

The above and other objects, features and other advantages of the present invention will be more cleanly understood from the following detailed description taken in conjunction with the accompanying drawings, in which.

DETAILED DESCRIPTION OF THE INVENTION

Figure 1A:
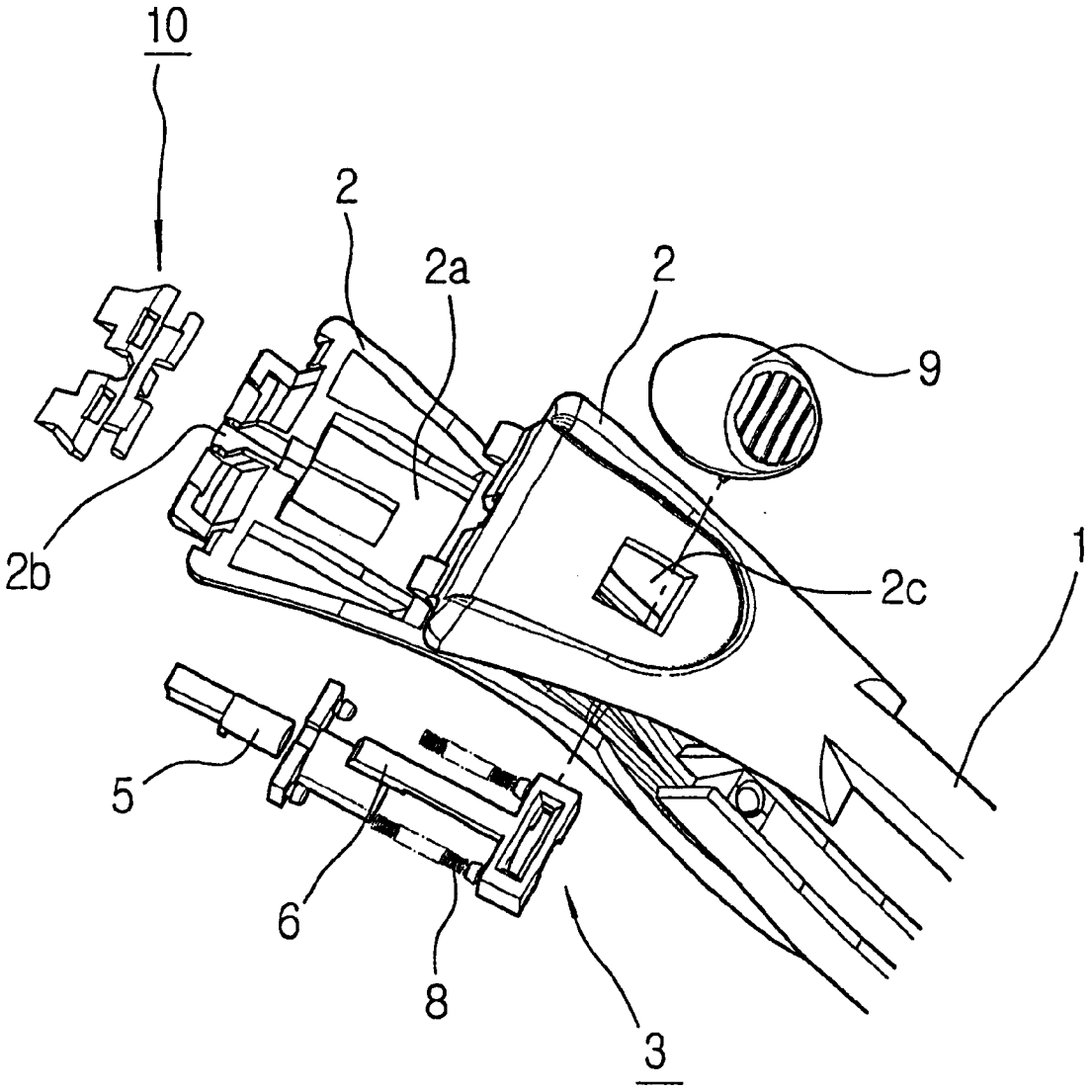
FIG. 1*a* is an exploded perspective view of a razor in accordance with the preferred embodiment of the present invention, showing the construction of the handle, cartridge holder, and elastic actuation unit used for rotating the cartridge holder in addition to removing a blade cartridge from the holder as desired.

Reference now should be made to the drawings, in which the same reference numerals are used throughout the different drawings to designate the same or similar components.

Figure 1B:
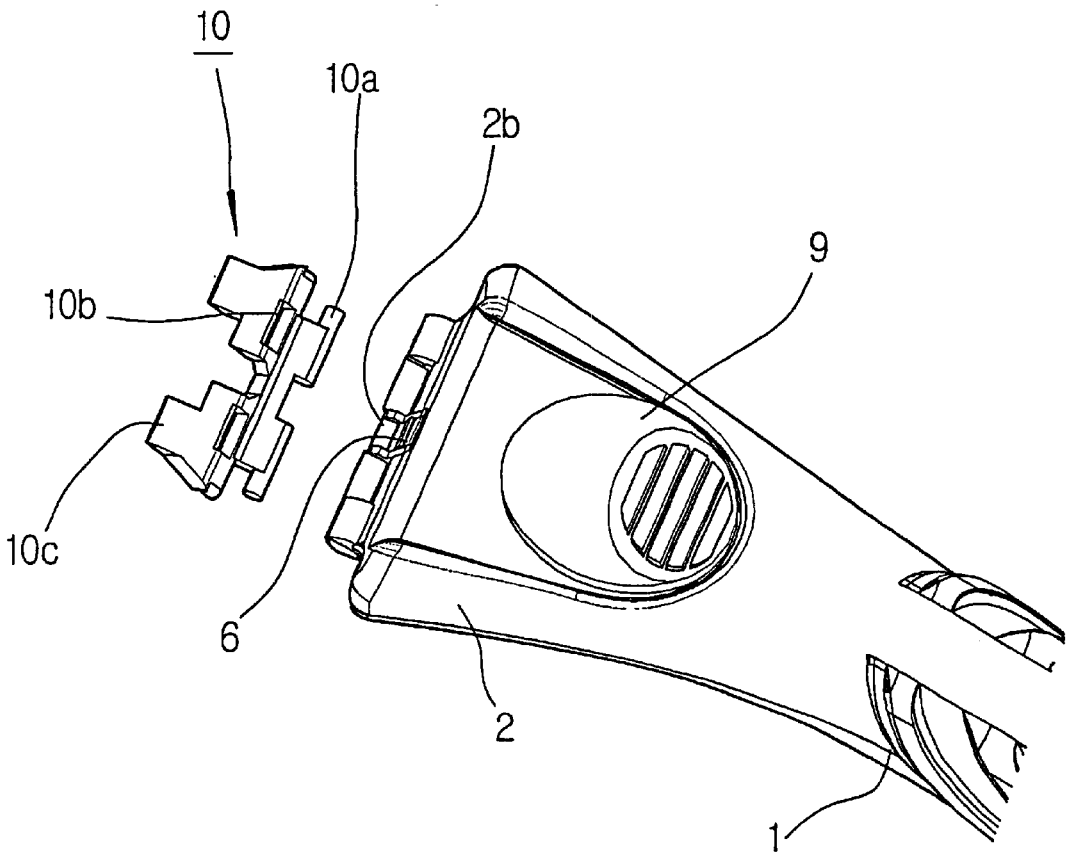
FIG. 1*b* is an exploded perspective view of the razor of this invention, showing both the elastic actuation unit completely assembled with the head of the handle, and the cartridge holder separated from the actuation unit.

FIG. 1*a* is an exploded perspective view of a razor in accordance with the preferred embodiment of the present invention, showing the construction of the handle, cartridge holder, and elastic actuation unit of the razor. FIG. 1*b* is an exploded perspective view of the razor of this invention, showing both the elastic actuation unit completely assembled with the head of the handle, and the cartridge holder separated from the actuation unit. In the razor of this invention, it is necessary to make at least a part of the handle 1 using a heavy material, such as a metal, so as to give desired weight to the handle 1, thus allowing a user to stably and safely manipulate the razor while shaving. It is preferable to set the part, made of such a heavy material, in the handle 1 along the axial direction of the handle 1 so as to maintain the shape of the handle 1.

In order to allow a user to stably and comfortably hold the handle 1 while shaving, the handle 1 is preferably fabricated with a soft rubber part at its external surface. The soft rubber part also accomplishes a desired combination with the remaining parts of the handle 1 made of a metal or plastic, thus improving the appearance of the razor.

In the razor of this invention, the head 2 is a wide portion provided at the front end of the handle 1, and holds both the cartridge holder and the elastic actuation unit of this invention as will be described later herein.

The head 2 has a double-stage structure fabricated with upper and lower head parts. The lower part of the head 2 is provided with a mounting depression 2*a* on its upper surface. This mounting depression 2*a* is defined by a plurality of reinforcing ribs, with a center channel 2*b* axially extending from the depression 2*a* to the front edge of the head 2. A knob seat opening 2*c* is formed at the center of the upper surface of the upper head part so as to pass the locking hooks of an actuation knob 9 when the knob 9 is set on the razor as will be described later herein. When the upper and lower parts of the head 2 are assembled into a single body, the mounting depression 2*a* of the lower head part is exposed to the atmosphere through the knob seat opening 2*c*.

FIGS. 3*a*, 3*b*, 3*c* and 3*d* are views, showing the construction of an elastic actuation unit provided in the razor of this invention. As shown in the drawings, the elastic actuation unit 3 of this invention comprises several parts, that is: a base block 4, first and second pushers 5 and 6, first and second biasing members 7 and 8, and an actuation knob 9, which are assembled into a single body such that they are operated in conjunction with each other.

In the elastic actuation unit 3, the base block 4 is designed to be stably and closely seated in the mounting depression 2*a* of the head 2. An axial bore 4*a* having a predetermined depth is axially formed in the base block 4. The front end of the base block 4 is flanged upward, leftward and rightward, thus forming a front flange having opposite side wings. A guide notch 4*b* is formed at the top center of the front flange of the base block 4, while a first spring holder 4*c* is provided at the rear surface of each side wing of said front flange.

In such a case, the bottom of the guide notch 4*b* is positioned higher than the top surface of the main body of the base block 4, thus forming a step between the bottom of the guide notch 4*b* and the top surface of the block's main body. A locking slot 4*d* having a predetermined length is axially formed on the bottom surface of the base block 4 such that the slot 4*d* communicates with the axial bore 4*a*.

The first biasing member 7, having a compression coil spring shape with high spring force, is axially set within the axial bore 4*a*. The first pusher 5 is inserted into the front end of the bore 4*a* so as to be movably set in the center channel 2*b* of the head 2 at its front portion and normally biased forward by the first biasing member 7. The above first pusher 5 is a longitudinal single body, which is divided into front and rear sections by a stopper 5*a* partially formed around the lower and opposite sides of the middle portion of said pusher 5. The front part of the first pusher 5 is a solid body with a rectangular cross-section, and is cut at its front surface to form a V-surface. The rear part of the first pusher is a hollow cylindrical body movably received in the axial bore 4*a* of the base block 4.

The hollow cylindrical rear part of the first pusher 5 is axially cut at the lower portion of its sidewall, thus forming an elastic guider 5*b* on said sidewall with a projection provided at the end of the guider 5*b*. When the first pusher 5 is inserted into the bore 4*a* of the base block 4, the elastic guider 5*b* of the pusher 5 is elastically compressed by the sidewall of the bore 4*a* until it is elastically restored to its original state at a time it reaches the guide slot 4*d* of the base block 4, thus movably engaging with said guide slot 4*d* at its projection. Therefore, it is possible to prevent an undesired removal of the first pusher 5 from the bore 4*a*, with the movable distance of the first pusher 5 relative to the bore 4*a* being limited by both the stopper 5*a* and the projection of the guider 5*b*.

The second pusher 6 is axially and movably seated on the top surface of the base block 4 while engaging with the guide notch 4*b* of the block 4. The second pusher 6 has the same width as that of the first pusher 5, and is notched at its lower surface to form a longitudinal notch, of which the depth is equal to the height of the bottom of the guide notch 4*b* and the length is equal to the maximum movable distance of the second pusher 6. When the second pusher 6 is seated on the base block 4, the longitudinal notch of the pusher 6 is seated on the guide notch 4*b* of the block 4. It is thus possible to limit the movable distance of the second pusher 6 by the step of the guide notch 4*b*. The front surface of the second pusher 6 is chamfered along its top edge.

The rear end of the second pusher 6 forms a pressure body 6*a*, having the same height and width as those of the opposite side wings of the base block's front flange. A second spring holder 6*b*, having the same shape as that of the first spring holder 4*c*, is provided at the front surface of each side part of the pressure body 6*a* at a position corresponding to said first spring holder 4*c*. A top opening, having a rectangular profile, is formed on the top wall of the pressure body 6*a* at the center, with two locking rails 6c formed along opposite side edges of said top opening to catch the locking hooks of the actuation knob 9 as will be described later herein. The lower surface of the pressure body 6*a* is cut at its central portion to form an arch opening coinciding with the rounded upper surface of the base block 4, and so the pressure body 6*a* is smoothly movable along the rounded upper surface of the block 4 without creating any interference when the second pusher 6 axially moves on the base block 4.

Two second biasing members 8, having a compression coil spring shape, are set between the side wings of the base block 4 and the pressure body 6*a* of the second pusher 6 while being held by the first and second spring holders 4*c* and 6*b* at opposite ends thereof. It is thus possible to accomplish an elastic movement of the second pusher 6 relative to the base block 4. The maximum forward moving distance of the second pusher 6 relative to the base body 4 is determined by a difference between the normal position and fully compressed position of each second biasing member 8.

In the preferred embodiment of the present invention, two second biasing members 8 are provided along opposite sides of the elastic actuation unit 3. However, it should be understood that the number of the second biasing members 8 may be set to one in place of two. In addition, the position of the second biasing members 8 on the actuation unit 3 may be changed from the position of the preferred embodiment without affecting the functioning the invention if the biasing members 8 effectively bias the second pusher 6.

The actuation knob 9 is inserted into the knob seat opening 2*c* of the head 2 until it is closely caught by the locking rails 6*c* of the pressure body 6*a* at its locking hooks 9*b*. The locking hooks 9*b* are formed at the lower ends of two locking arms 9*a* vertically extending downward from the lower surface of the knob 9. When the actuation knob 9 is inserted into the top opening of the pressure body 6*a*, the two locking arms 9*a* of the knob 9 are elastically compressed inwardly by the top opening until they are elastically restored to their original state to engage with the locking rails 6*c* of the opening. It is thus possible for the actuation knob 9 to be firmly assembled with the pressure body 6*a* of the second pusher 6.

Figure 4A:
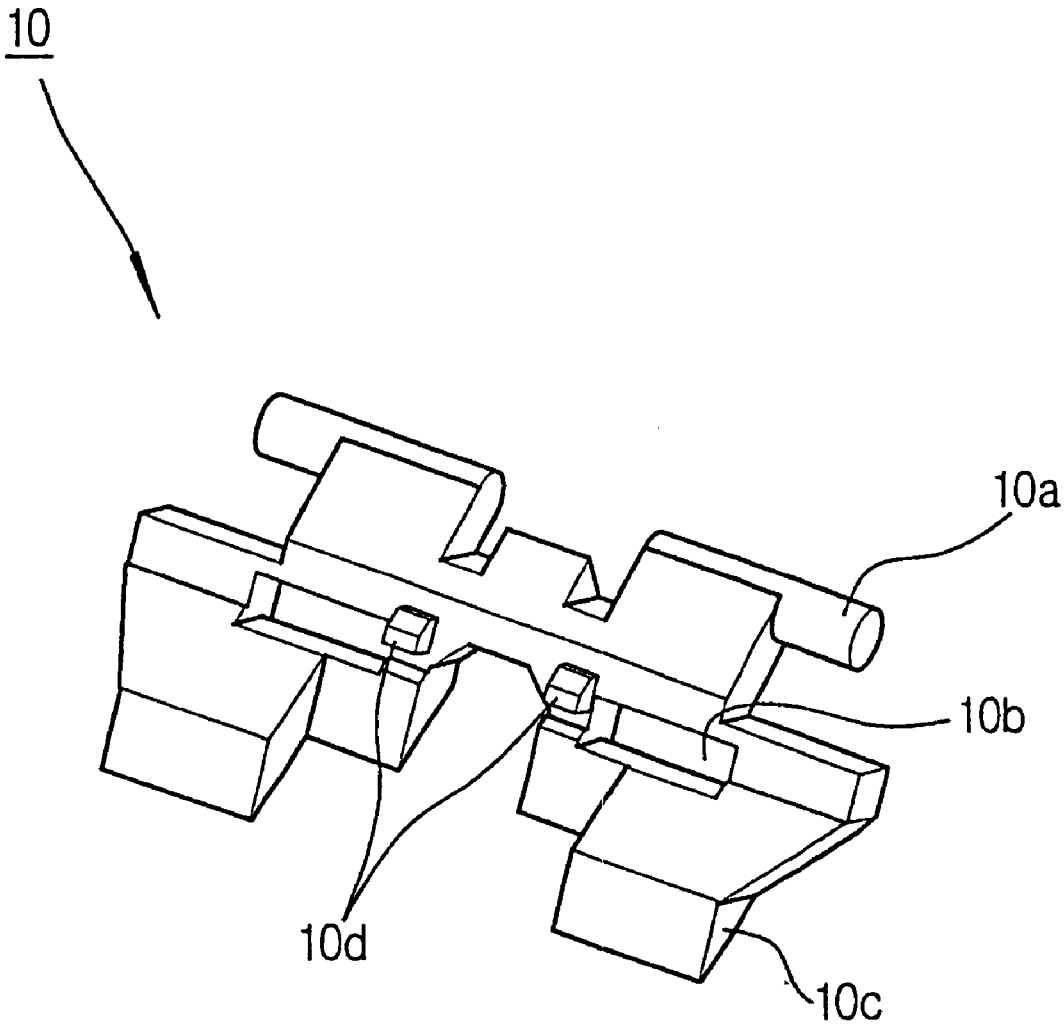
FIG. 4*a* is a bottom perspective view of the cartridge holder of this invention, showing the structure of the holder for holding a blade cartridge.
Figure 4B:
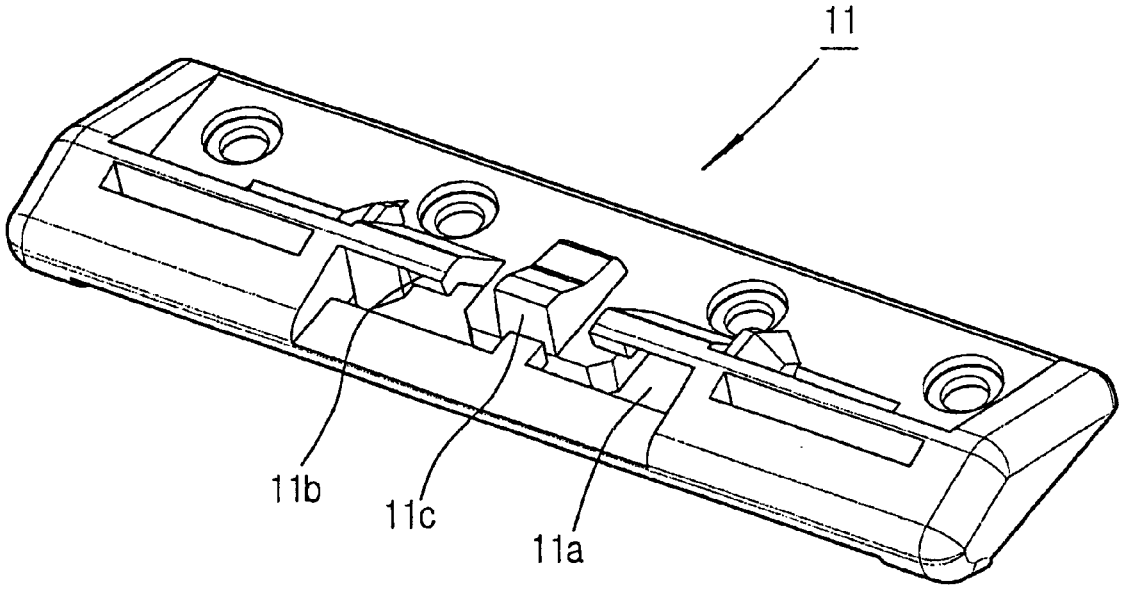
FIG. 4*b* is a bottom perspective view of a blade cartridge usable with the cartridge holder of FIG. 4*a*.

FIG. 4*a* is a bottom perspective view of the cartridge holder provided in the razor of this invention, showing the structure of the holder. FIG. 4*b* is a bottom perspective view of a blade cartridge usable with the cartridge holder of FIG. 4*a*. In the present invention, it is preferable to make the cartridge holder 10 using a metal in the same manner as the prior art. The cartridge holder 10 of this invention is hinged to the front end of the head 2 such that it is operated in conjunction with the elastic actuation unit 3 set in the head 2.

As shown in FIG. 4*a*, the cartridge holder 10 is an integrated body, with two opposite hinge shafts 10*a* formed at the rear end of the holder 10 and acting as the hinged points of the blade cartridge 11 so as to allow the cartridge 11 to be rotatable relative to the head 2 of the handle 1. This holder is hinged to the front end of the head 2 of the handle 1 at the two hinge shafts 10*a*, thus allowing a swinging action of the blade cartridge 11 relative to the head 2. Two locking holes 10*b*, each having a locking edge, are formed on the cartridge holder 10, while two locking pieces 10*c* are formed at the opposite ends of the front edge of the holder 10. Two locking projections 10*d* are formed on the lower surface of the holder 10 at positions around the inside edges of the two locking holes 10*b*.

A cam surface is formed on the rear edge of the cartridge holder 10 at the intermediate portion between the two opposite hinge shafts 10*a*, and engages with the V-surface of the front end of the first pusher 5 projecting forward from the head 2. The cartridge holder 10 is thus normally biased to its stop position. A blade cartridge 11 having multiple blades is detachably attached to the cartridge holder 10.

In the present invention, it should be understood that the biasing structure for the cartridge holder 10 may be accomplished by a biasing means set between the head 2 and the holder 10, such as a plate spring or a coil spring.

The blade cartridge 11 is attached to the cartridge holder such that the cartridge 11 can swing around the hinged points formed by the hinge shafts 10*a* of the holder 10. Since the two hinge shafts 10*a* are positioned at an appropriate position in the front of the head 2, it is possible for the cartridge 11 to swing around the hinged points through a large angle, and smoothly come into contact with the skin of the face at the blades with uniform pressure while shaving. In the present invention, the hinged points of the cartridge 11 formed by the hinge shafts 10*a* are preferably positioned below the central axis of the cartridge 11, thus allowing the cartridge 11 to create a single directional moment during a rotating action of the cartridge 11 around the hinged points and allowing a restoring moment of the cartridge 11 to be applied to only the cartridge holder 10 of the head 2. Therefore, the razor of this invention almost completely prevents the blades of the cartridge 11 from forming any pressure capable of damaging or cutting the skin while shaving.

of course, the number of blades set in the blade cartridge 11 is not limited in the present invention. That is, a blade cartridge having a single blade or multiple blades may be freely used with the razor of this invention.

In order to allow the blade cartridge 11 to be more easily and simply attached to the cartridge holder 10 and enlarge the swing angle of the cartridge 11, two longitudinal openings 11*a* are formed on the central portion of the lower surface of the cartridge 11 as shown in FIG. 4*b*. An inclined guider 11*b* is formed on the lower surface of the cartridge 11 at a position around each of the two openings 11*a* so as to guide the two locking pieces 10*c* when the cartridge 11 is attached to the holder 10. A projection 11*c* is formed on the lower surface of the blade cartridge 11 at the intermediate portion between the two openings 11*a*.

In order to attach the blade cartridge 11 to the cartridge holder 10, the two locking pieces 10*c* of the holder 10 are inserted into the two openings 11*a* of the cartridge 11 after passing the inclined guiders 11*b*. In such a case, the locking projections of the inclined guiders 11*b* are caught by the locking edges of the two locking holes 10*b*, thus accomplishing a desired attachment of the blade cartridge 11 to the cartridge holder 10. In addition, the chamfered front end of the second pusher 6, projecting forward from the center channel 2*b* of the head 2, comes into contact with the projection 11*c* of the cartridge 11. In such a case, the second pusher 6 is elastically operated in conjunction with an operation of the actuation knob 9. When the knob 9 is pushed forward after shaving, the blade cartridge 11 is easily and simply removed from the cartridge holder 10 of the razor.

Figure 2:
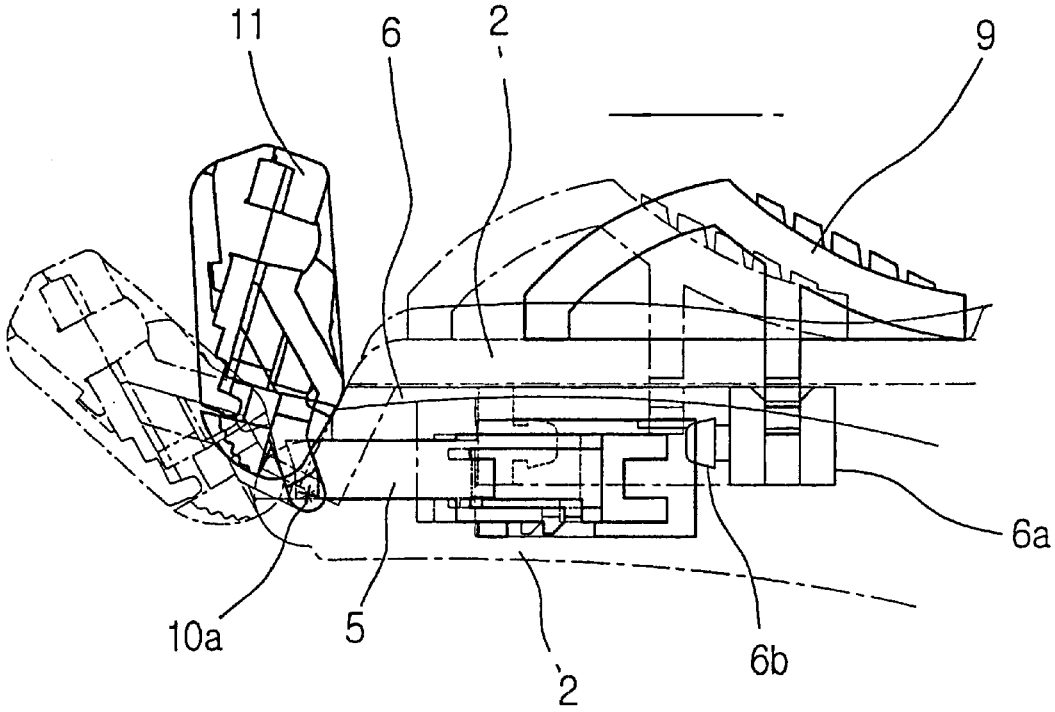
FIG. 2 is a sectional view of the razor of this invention, showing a swinging action of a blade cartridge attached to the cartridge holder completely assembled with the razor.
Figure 3A:
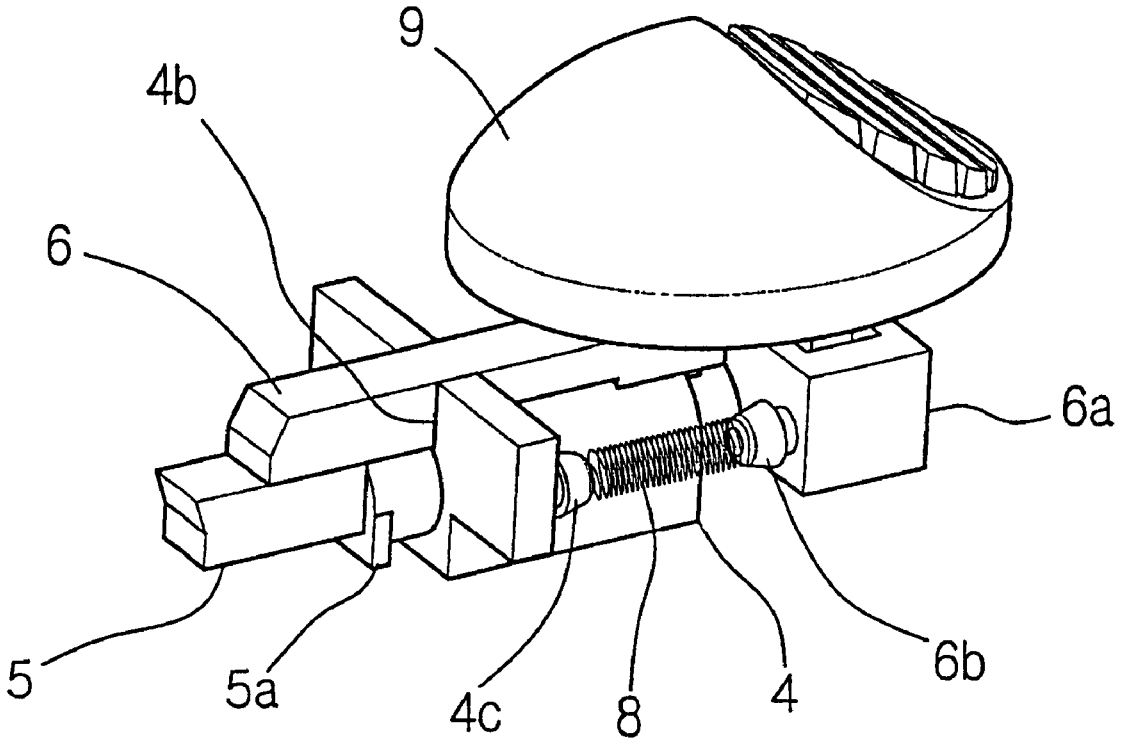
FIG. 3*a* is a perspective view of the elastic actuation unit of this invention, with the first and second pushers of the unit commonly assembled with the actuation knob into a single body.
Figure 3B:
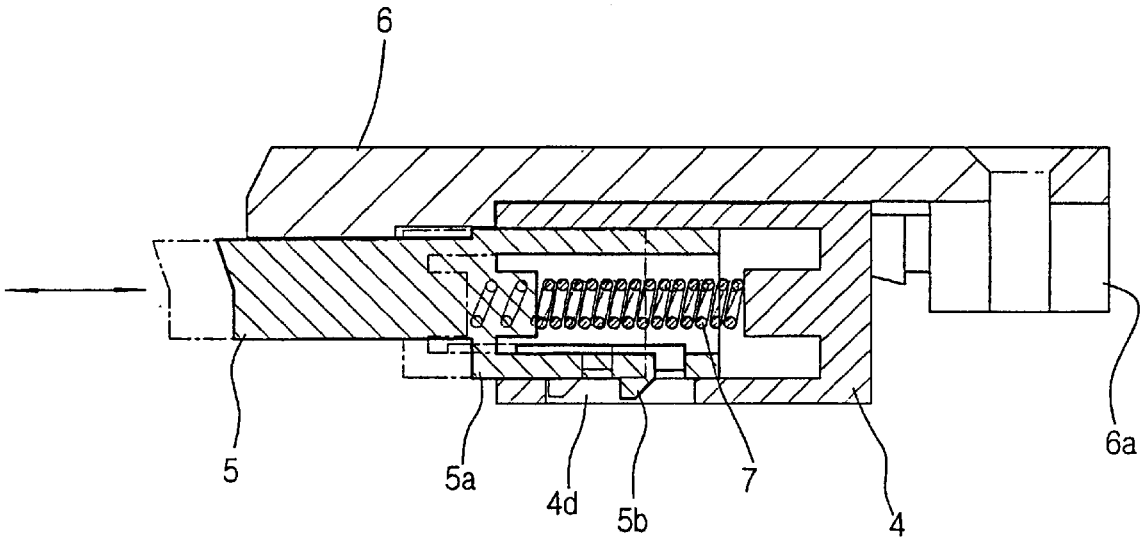
FIG. 3*b* is a sectional view of the elastic actuation unit of FIG. 3*a*, taken along the longitudinal axis of the unit to show the operation of the first and second pushers of the unit.
Figure 3C:
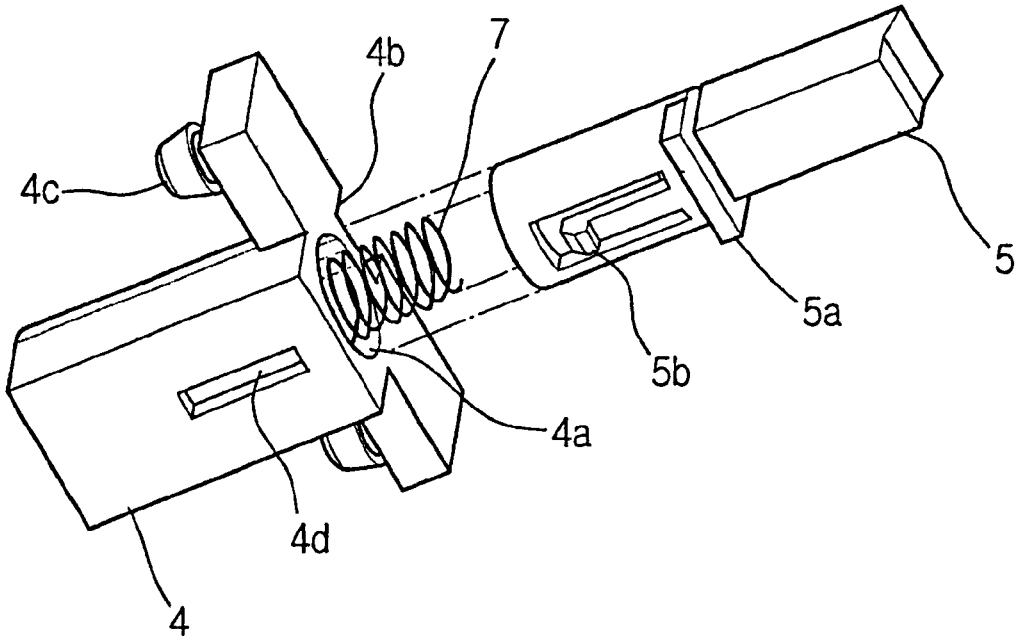
FIG. 3*c* is an exploded perspective view of the first pusher of this invention, showing the construction of said first pusher.
Figure 3D:
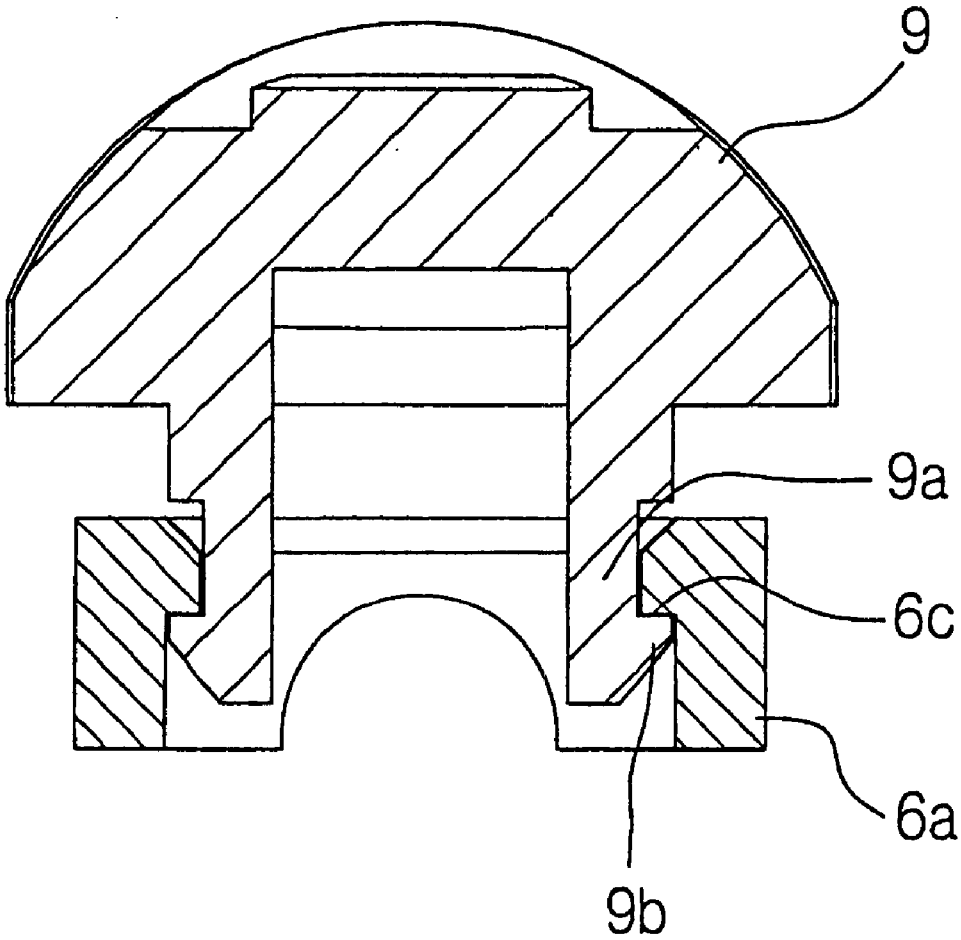
FIG. 3*d* is a sectional view of the structure for attaching the second pusher of this invention to the actuation knob mounted to the head of the handle of the razor.

FIG. 2 is a sectional view of the razor of this invention, showing a swinging action of the blade cartridge attached to the cartridge holder of the razor. As shown in the drawing, the elastic actuation unit 3 is completely set in the head 2 of the handle 1, with the cartridge holder 10 attached to the head 2. In order to attach a blade cartridge 11 to the cartridge holder 10 for shaving, the two locking pieces 10*c* of the holder 10 are inserted into the two openings 11*a* of the cartridge 11 after passing the inclined guiders 11*b*. In such a case, the locking projections of the inclined guiders 11*b* are caught by the locking edges of the two locking holes 10*b*, thus accomplishing a desired attachment of the blade cartridge 11 to the cartridge holder 10.

Figure 5:
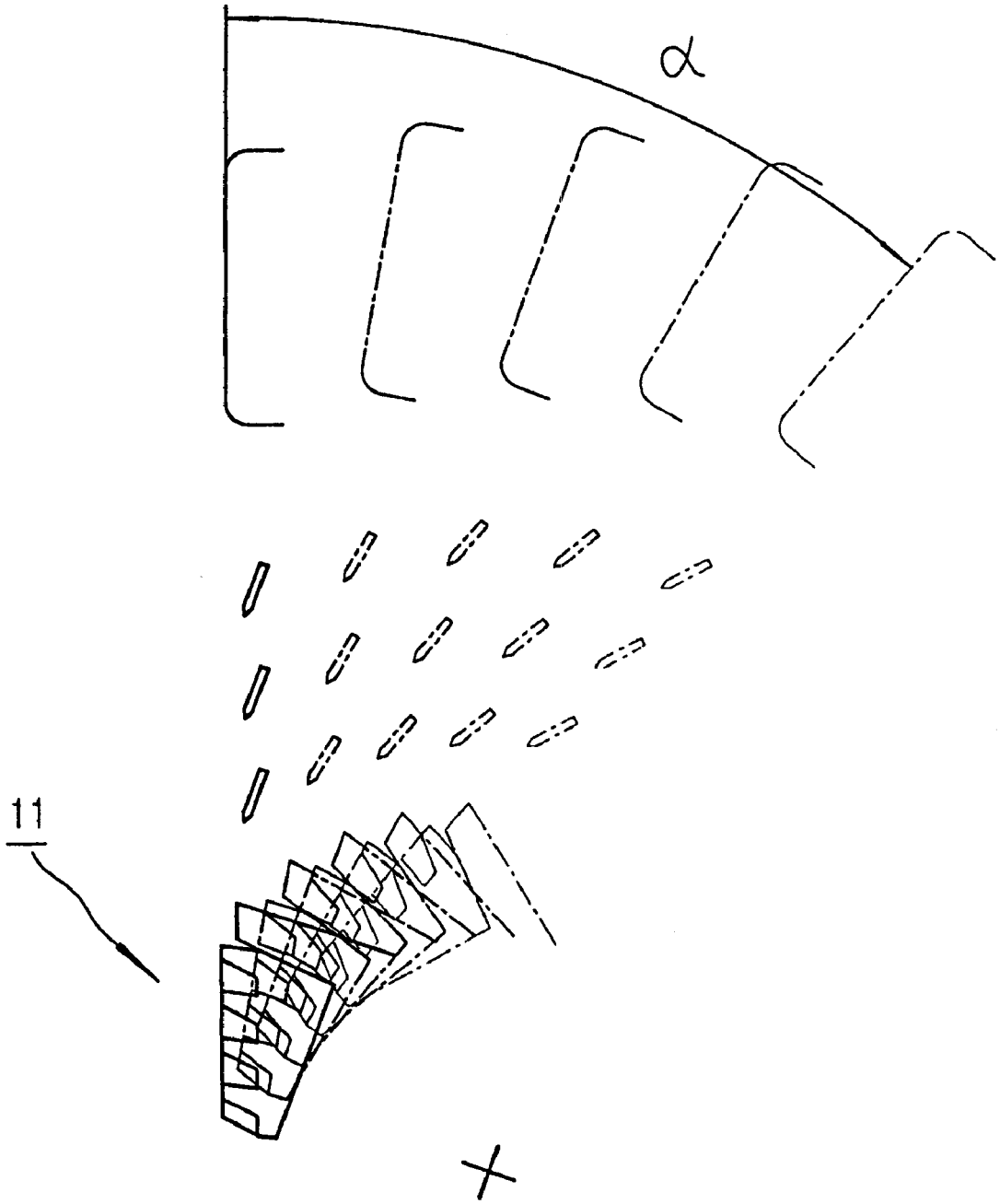
FIG. 5 is a view, showing the trace of the blade cartridge of this invention swinging around hinged points.

FIG. 5 is a view, showing the trace of the blade cartridge of this invention swinging around hinged points. As shown in the drawing, the blade cartridge 11 smoothly and sensitively swings around the hinged points. That is, the blade cartridge 11 is rotated around the hinge shafts 10*a* of the cartridge holder 10, acting as the hinged points of the blade cartridge 11, and so it is possible for the blades of the cartridge 11 to effectively and cleanly shave the face with both uniform shaving force and uniform pressure regardless of a variety of cutting resistances applied to the cartridge 11 due to both the hair density and the curvatures of the face. It is also possible for the blade cartridge 11 to enlarge its swing angle and accomplish a smooth shaving operation. In addition, when the blades of the cartridge 11 come into contact with very small blemishes on the face while shaving, the blades effectively and comfortably shave the face without damaging or cutting the skin of the face, since the first pusher 5 elastically and appropriately holds the cartridge holder 10 while sensitively responding to such blemishes of the skin due to the spring force of the first biasing member 7.

That is, the safety razor of this invention allows the blade cartridge 11 to smoothly move and swing along the curved skin of the face while maintaining both uniform shaving force and uniform pressure, thus effectively and cleanly shaving the face without damaging or cutting the curved skin of the face. In order to remove the blade cartridge 11 from the cartridge holder 10 after shaving, the actuation knob 9 provided at the top surface of the head 2 is pushed forward. When the knob 9 is operated as described above, the second pusher 6 advances forward from the fully retracted position while compressing the second biasing members 8, and forcibly pushes the projection 11*c* of the cartridge 11. Therefore, the locking projections of the inclined guiders 11*b* of the cartridge 11 are removed from the locking edges of the two locking holes 10*b* of the holder 10, and so the blade cartridge 11 is removed from the cartridge holder 10.

As described above, the present invention provides a safety razor designed to improve the moving trace of the blade cartridge on the curved skin, thus maintaining a uniform skin contact area and uniform skin contact pressure, with the hinge points of the blade cartridge of the razor provided at the head of the handle at a position below the central axis of the cartridge, so as to enlarge the swing angle of the blade cartridge. Due to such hinged points, the blade cartridge is rotatable backward when a user unconsciously and excessively presses the cartridge against the skin while shaving. Therefore, the blades of the cartridge effectively and cleanly shave the face without damaging the skin regardless of a variety of cutting resistances applied to the cartridge due to both the hair density and the curvatures of the face. Therefore, the razor of this invention accomplishes desired operational safety and desired shaving effect. This razor is also designed to easily and simply attach or remove the blade cartridge to the head of the handle as desired without creating any mechanical interference. The razor is thus convenient to both users and manufacturers. Another advantage of the razor of this invention resides in that it is usable for a desired lengthy period of time.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A safety razor, comprising:

a handle having a head provided with a mounting depression, a center channel axially extending from the depression to the front edge of said head, and a knob seat opening formed at an upper surface of the head;

an elastic actuation unit seated in said mounting depression of the head and consisting of:

a base block seated in said mounting depression of the head and having an axial bore, with a first pusher movably seated in said axial bore while being normally biased forward by a first biasing member;

a second pusher axially and movably seated on said base block, with a second biasing member normally biasing the second pusher to the back relative to the base block; and an actuation knob seated on said knob seat opening of the head, and elastically moving the second pusher forward or backward in accordance with an operation of a user;

a cartridge holder rotatably attached to the front end of said head, said cartridge holder being provided with a cam surface for being normally biased by said first pusher so as to elastically return to its stop position, said cartridge holder also having a plurality of cartridge locking pieces; and a blade cartridge having a projection formed on its lower surface at a middle portion, and removably attached to the cartridge locking pieces of the cartridge holder such that the front end of said second pusher comes into contact with said projection.

2. The safety razor according to claim 1, wherein said base block of the elastic actuation unit has:

the axial bore formed from the front end of the base block to a predetermined depth, said axial bore having an axial guide slot having a predetermined length; and a front flange having opposite side wings, said front flange being formed by extending the front end of said base block upward, leftward and rightward to predetermined widths, with a guide notch formed at a top center of the front flange and a first spring holder provided at a rear surface of each of said side wings;

said first pusher is movably seated in said axial bore of the base block while being normally biased forward by the first biasing member, with an elastic guider formed on said first pusher and provided with a projection at its end for being caught by the axial guide slot of said axial bore of the base block;

said second pusher is axially seated on the base block while passing through said guide notch of the front flange of the base block, with a pressure body formed at the rear end of said second pusher and assembled with the actuation knob at its upper surface, said second pusher also having a second spring holder having the same shape as that of said first spring holder of the base block and provided at the front surface of each side part of said pressure body at a position corresponding to said first spring holder; and said second biasing member set between each of the side wings of said base block and the pressure body of said second pusher while being held by the first and second spring holders.

3. The safety razor according to claim 1, wherein said cartridge holder comprises:

two opposite hinge shafts formed at its rear end and hinged to the head of the handle, and acting as hinged points of the blade cartridge;

two locking holes formed on the cartridge holder at opposite sides and each having a locking edge;

the locking pieces formed at the opposite ends of the front edge of said cartridge holder at positions in front of the two locking holes; and two locking projections formed on the lower surface of said cartridge holder at positions around the inside edges of said locking holes.

4. The safety razor according to claim 1, wherein said cartridge comprises:

two longitudinal openings formed on the central portion of a lower surface of said cartridge;

an inclined guider formed on the lower surface of said cartridge at a position around each of the two longitudinal openings so as to guide the two locking pieces of the cartridge holder when the cartridge is attached to the holder; and the projection formed on the lower surface of said cartridge at the intermediate portion between the two longitudinal openings.

* * * * *